United States Patent [19]

Boucher et al.

[11] Patent Number: 4,815,048

[45] Date of Patent: Mar. 21, 1989

[54] DUAL AXIS TRANSDUCER

[75] Inventors: Stephen G. Boucher, Amherst; Christopher S. Lins, Bow; Michael J. Simoneau, Nashua, all of N.H.

[73] Assignee: AirmarTechnology Corporation, Milford, N.H.

[21] Appl. No.: 81,821

[22] Filed: Aug. 5, 1987

[51] Int. Cl.[4] ..... H04R 1/00

[52] U.S. Cl. ..... 367/173; 367/104; 367/120; 367/165

[58] Field of Search ..... 367/104, 120, 138, 165, 367/173; 73/633, 634

[56] References Cited

U.S. PATENT DOCUMENTS

| | | | |
|---|---|---|---|
| 2,865,014 | 12/1958 | Malm | 367/104 |
| 3,553,638 | 1/1971 | Sublett | 367/104 |
| 3,752,255 | 8/1973 | Hill et al. | 73/633 |

FOREIGN PATENT DOCUMENTS

| | | | |
|---|---|---|---|
| 1072161 | 12/1957 | Fed. Rep. of Germany . | |
| 2803617 | 9/1978 | Fed. Rep. of Germany . | |
| 1600873 | 11/1970 | France | 73/633 |

OTHER PUBLICATIONS

David M. Quarders, "Method of Using Searchlight Sonar", by Furuno Electric Company LTD of Japan.

*Primary Examiner*—Deborah L. Kyle
*Assistant Examiner*—John W. Eldred
*Attorney, Agent, or Firm*—Hamilton, Brook, Smith & Reynolds

[57] ABSTRACT

A dual axis transducer assembly comprises a transducer (20), a yoke (24) which mounts the transducer for oscillating movement about a substantially horizontal axis. A turntable (28) mounts the yoke and hence the transducer for oscillating motion about a vertical axis. Separate motors (10) and (12) supply motion to the transducer and control means (84), (86), (88) are employed to control the operation of the motors.

5 Claims, 5 Drawing Sheets

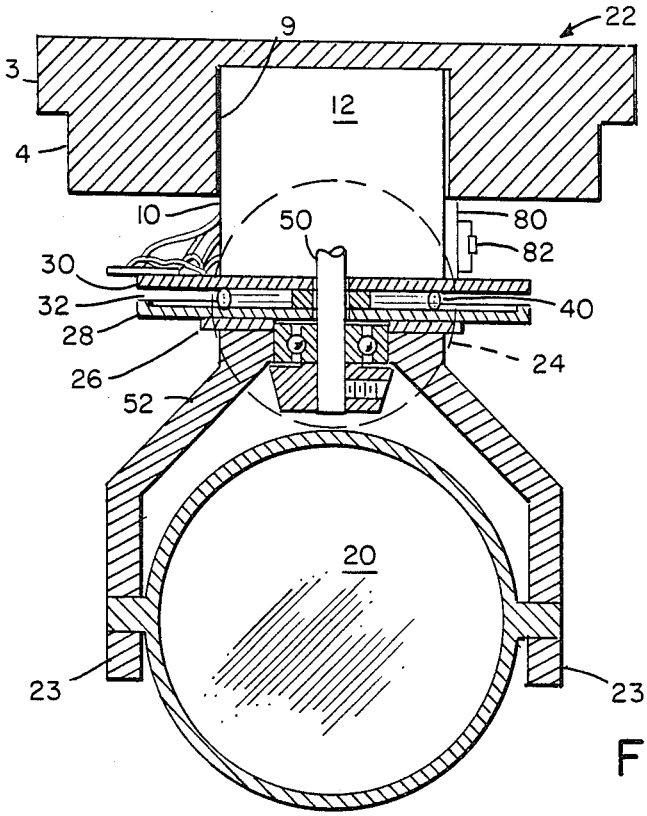
FIG. 5
FIG. 6
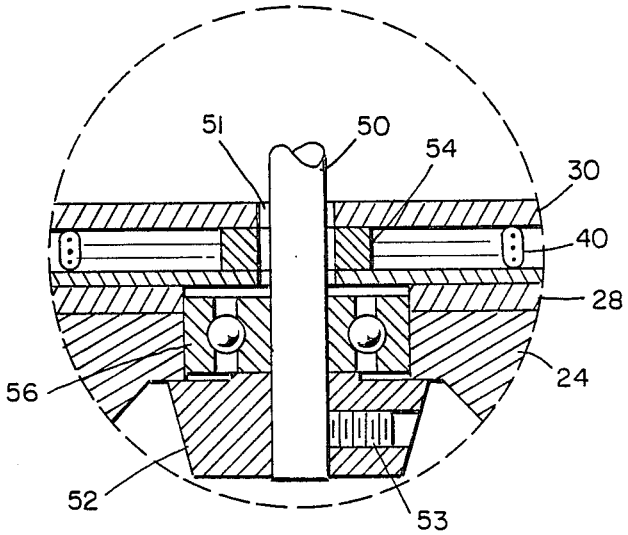

DUAL AXIS TRANSDUCER

FIELD OF THE INVENTION

The invention relates to marine electronic instruments such as transducers and sensors in general and, more specifically, to a dual axis or searthlight type sonar which is mountable on the hull of a boat.

BACKGROUND OF THE INVENTION

There are many types of marine instruments available for commercial and pleasure craft today. Some of them include devices for measuring water depth, boat speed, temperature, as well as, locating fish. The present invention resides in a sonar device, and particularly the type called a search-light sonar. A sonar is an echo sounder which includes a transducer to emit a soundbeam downwardly from the boat. When the beam strikes something, such as the bottom, it will reflect an echo back to the transducer. This is converted to electrical energy, amplified and displayed as information on a screen. It may also display information on a paper graph, flashing device and even on video displays.

While echo sounders initially were employed to give information about depth, more sophisticated types of devices provide information about the location of fish, both individuals and schools, as well as, to the type of bottom that is located directly below and outwardly around the boat.

A searchlight sonar employs a narrow soundbeam that can be pointed in a variety of directions. Generally speaking, the beam is directed in a forward and downward direction. For example, it may be projected downwardly from the boat at 45° while simultaneously oscillated back and forth over an arc which typically might be 90°. It is to this type of mechanism that the present invention has particular applicability.

Searchlight or scanning sonars are not new even in fish locating. Basically, a scanning sonar employs a transducer which is tiltable about a substantially horizontal axis so as to be located with a desired amount of downwardly inclined tilt. It is also rotatable about a horizontal axis so as to be able to scan back and forth, left and right, while the boat proceeds forward at a slow speed. Traditionally, the transducers have been mounted in yokes which are rotated by one motor and which are tilted by a second motor, which is mounted either on the yoke or the yoke support. Thus, one of the motors has to accommodate the mass of the transducer plus another motor as well.

The yokes are frequently mounted on turntables and the turntable itself carries the second motor for tilting the transducer. This involves a substantial amount of mass for the first motor to rotate.

Accordingly, it is an object of this invention to produce a searchlight sonar having the smallest mass possible in order to be driven by the smallest motors possible in order to reduce size, weight and cost.

Another problem encountered in prior art searchlight sonars is that the wiring required by two motors, one of which must move the other motor, is complicated and subjects its soldering to undesirable stress.

Thus, yet another object of this invention is to reduce wiring to a minimum and assure that the stress that it is subjected to is minimized.

In a fish scanning operation the sonar is adjusted to a predetermined downward tilt and this tilt must be maintained as the sonar transducer is panned or otherwise oscillated to maintain a constant angle of scanning. If the tilt angle were constantly varied as the scanning angle changes, the resultant readout, be it on a paper graph or on a visible display, would be compounded and to a large degree unintelligible.

Consequently, another feature of this invention is to produce a scanning sonar with means to assure that the sonar transducer is maintained at the specific tilt angle to which it is initially set.

SUMMARY OF THE INVENTION

The invention resides in a dual axis transducer wherein the transducer is mounted in a yoke for tilting movement about a substantially horizontal axis. A turntable mounts the yoke and hence the transducer for azimuthal movement about a substantially vertical axis. An elevation motor imparts tilting movement to the transducer and a second or azimuth motor, which is spaced from the turntable and the yoke, imparts rotational movement to the transducer.

There are rigid means for mounting both motors so that each imparts motion to the transducer without moving relative to each other. Each motor thereby does its job without having to move the mass of the other motor.

A fixed surface in the form of a plate is positioned substantially normal to the vertical axis about which the transducer rotates. The plate is parallel to the turntable and spaced a distance away from it in the direction of the axis of rotation thereby to create a gap between them. A wiring harness, which extends from the transducer is arranged in the shape of a coil within the gap. The coil expands and contracts as the transducer is oscillated about the vertical axis, first in one direction and then in another.

Initially the desired tilt angle is imparted to the transducer and there are means provided for preventing further tilting motion to the transducer when azimuthal motion is taking place.

A driving gear is secured to the azimuthal motor and is in engagement with a driven gear which is secured to the yoke to transmit oscillating rotary motion to the yoke. A bevel gear is in engagement with a gear quardrant which is secured directly to the transducer. The bevel gear is mounted on a shaft which passes through the yoke for free rotational movement relative to the yoke and driven gear. The shaft is attached to the elevation motor to impart tilting motion to the transducer independently of the rotational azimuthal motion.

Each of the motors are stepping motors and control means are provided for stepping the azimuthal motor in one direction and for stepping the elevational motor in the opposite direction at the same angular speeds when the transducer is being oscillated. This prevents the transducer from being tilted while being pivoted to maintain a constant scanning angle.

The above and other features of the invention including various novel details of construction and combinations of parts will now be more particularly described with reference to the accompanying drawings and pointed out in the claims. It will be understood that the particular dual axis transducer embodying the invention is shown by way of illustration only and not as a limitation of the invention. The principles and features of this invention may be employed and varied in numerous embodiments without departing from the scope of the invention.

DESCRIPTION OF THE DRAWINGS

FIG. 5 is a sectional view taken on the lines V—V on FIG. 1.

FIG. 6 is an enlarged sectional view of the mechanism shown within the dotted circle on FIG. 5.

DETAILED DESCRIPTION OF THE INVENTION

Figure 1:
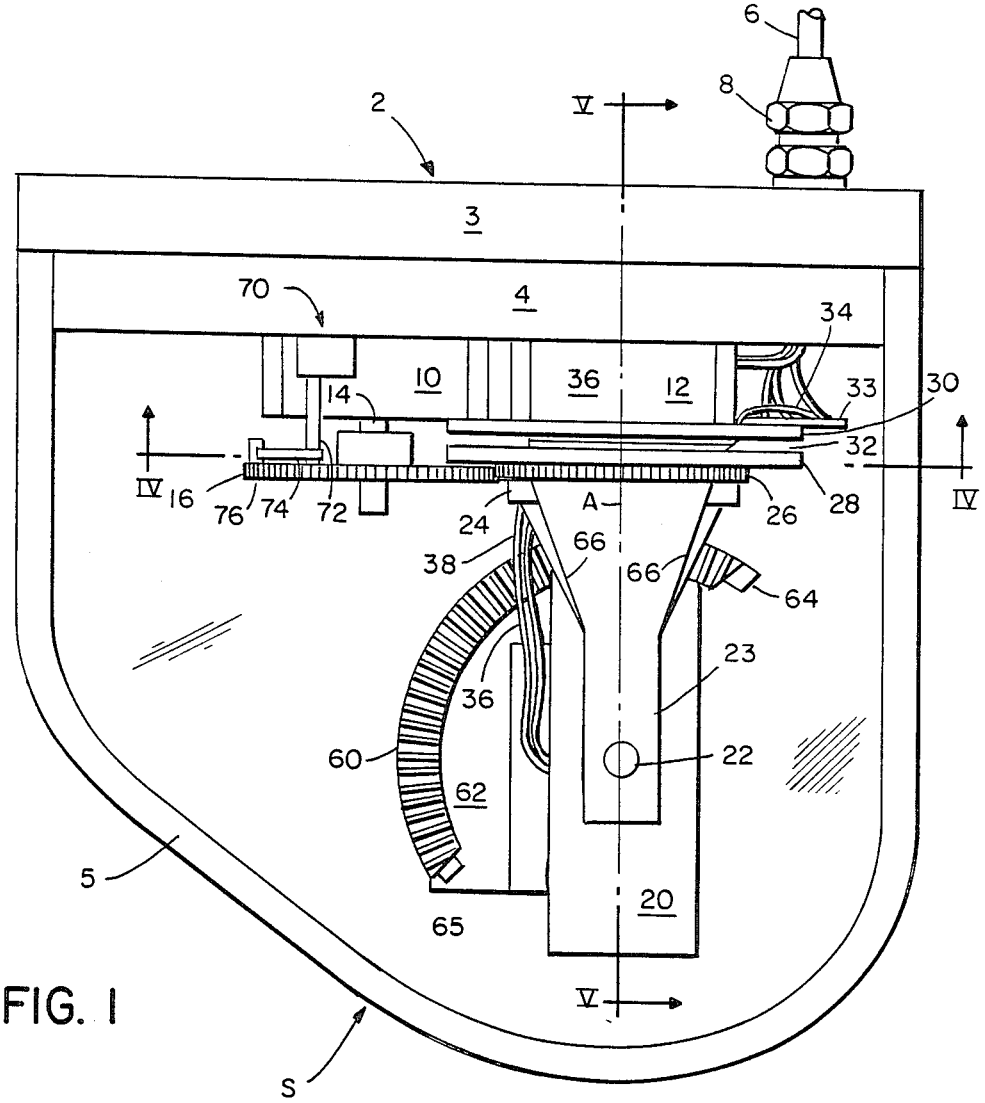
FIG. 1 is a side elevation of a dual axis sonar embodying features of the invention and with a cover in place.
Figure 2:
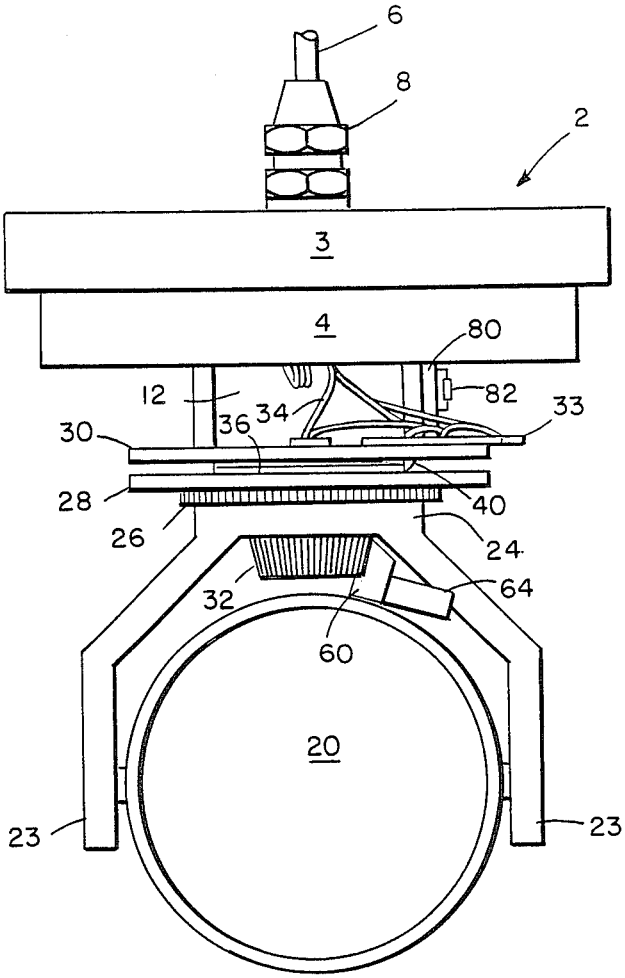
FIG. 2 is a front view of the sonar without the cover.
Figure 3:
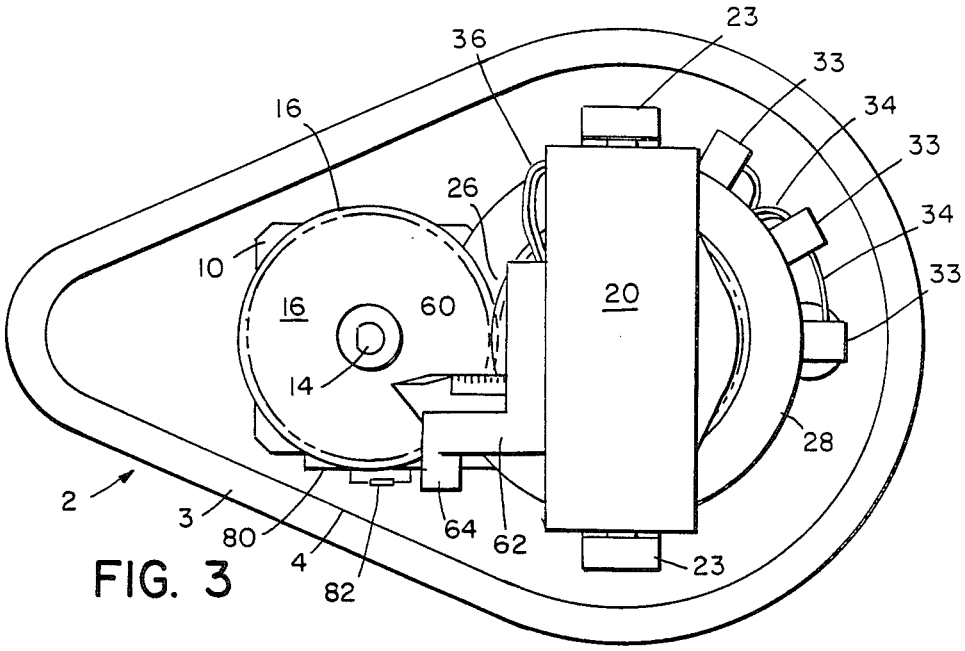
FIG. 3 is a bottom view.

In FIG. 1 there will be seen a searchlight sonar S embodying the features of the present invention. In operation, it is supported below the water line of a boat. It includes a plastic or ceramic base 2, which, as seen in FIG. 3, is teardrop in configuration. The base has a primary portion 3 and a secondary portion 4 of substantially the same shape as the primary portion but of smaller size. A plastic housing 5, shown only in FIG. 1, fits around and is sealed to the secondary base 3. The housing is filled with oil. An electric cable 6 extends from a connector 8 secured to the base 2 to electronic control and display apparatus located within the boat an not shown in FIG. 1. Such apparatus is designated as the manual control module 84 in FIG. 7 and described hereafter.

Mounted in a recess 9 (FIG. 5) in the base 2 and depending therefrom, is a first stepping motor 10. This is the azimuth or scanning motor. A second stepping motor 12, which is the tilt or elevation control motor, is located adjacent to the azimuth motor. Neither motor moves relative to the base 2. Extending from the azimuth motor 10 is a shaft 14 which mounts a driving gear 16.

A sonar transducer 20 is mounted for pivotal motion about a substantially horizontal axis on stub shafts 2 in arms 23 of a yoke 24. The yoke is rotatable about an axis A which also defines the axis of rotation of the tilt motor 12. At the top of the yoke 24 is a driven gear 26 which meshes with the driving gear 16. The gears are of the same diameter, hence, the driving ratio is one to one. Thus, rotation of the azimuth stepping motor 10 will rotate the gear 16, the gear 26 and hence, the yoke 24 and the transducer 20 at an angular speed equal to the angular speed of the stepping motor but in the opposite direction.

Figure 4:
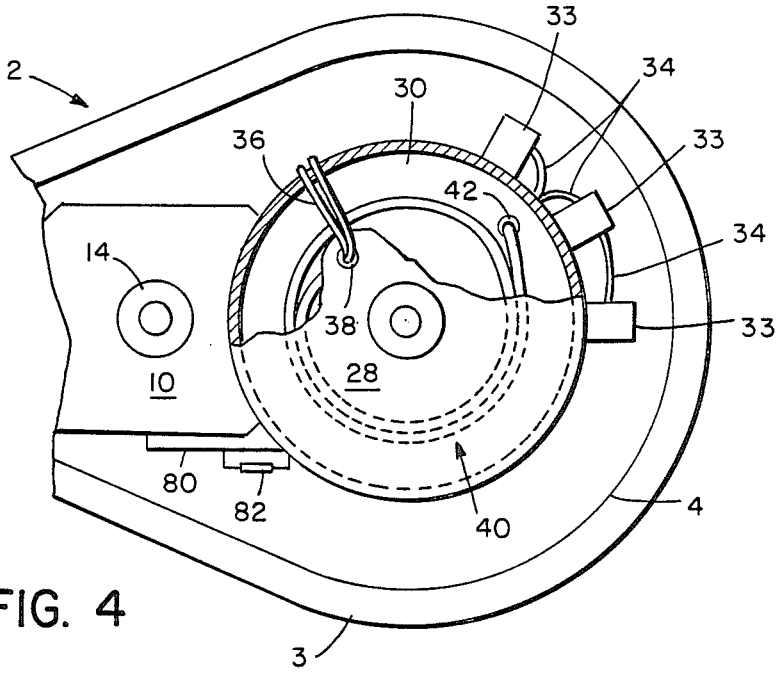
FIG. 4 is a sectional view taken on the lines IV—IV of FIG. 1.

The driven gear 26 and hence, the yoke 24, is mounted on the bottom of a first or lower turntable 28. The yoke 24 and the gear 26 and the turntable 28 rotate as a unit. The turntable 28 is circular in configuration and may be made from plastic or ceramic material. Spaced above the turntable 28 is a circular disc 30 of essentially the same diameter and having a flat lower surface. The circular disc 30 does not rotate, being fixed to the bottom of the tilt motor 12. A gap 32 exists between the turntable 28 and the disc 30. Secured to the disc 30 are a plurality of terminals 33 to which control wires generally indicated 34 are soldered. A harness of three wires 36 which lead from the transducer 20, pass through disc 30 as shown at 38 in FIG. 4. The harness is arranged in a helical coil 40, as seen in FIG. 4, of more than one turn in the gap 32 between the turntable 28 and the lower surface of the disc 30. The harness of wires 36 passes through the disc 30 at a point designated 42 and are connected to the appropriate terminals 33 on the disc 30. During the oscillating action of the transducer 20 the coil 40 of conductor leads as seen in FIG. 4, will continuously coil and uncoil within the slot 32 between the turntable 28 and the disc 30 and not subject any of the soldered connections to unwanted stress. Coiling also reduces fatigue in the wires per se.

Tilting of the transducer 20 is caused by the tilting or elevation motor 12. Extending downwardly from the motor 12 is a shaft 50 which passes through an opening 51 in the disc 30. The shaft 50 is journalled in a bearing 56 mounted in the upper end of the yoke 24. A bevel gear 52 is secured to the shaft 50 by a set screw 53. Thus, the bevel gear 52 is completely independent, rotationably, of the disc 30 which is always stationary, and the turntable 28 and the yoke 24 which rotate as a unit.

As will be seen in FIG. 1, a gear quardrant 60 is secured to the transducer 20 by an L shaped bracket 62 mounted on the back of the transducer 20 as seen in FIG. 3. A stop 64 projects from each end of the gear quadrant 60. The stops engage the yoke at points generally indicated 66 when the yoke is at the extreme positions of its movement. One position is when the transducer is in a vertical position, as seen in FIG. 1. Another is when it is in a horizontal position.

A stop mechanism generally indicated 70 is mounted on the secondary base portion 4 and includes an arm 72 which mounts a bifurcated foot 74 which in turn is engagable with a pin 76 projecting upwardly from the driving gear 16. This mechanism will be described in more detail hereinafter but suffice it to say its purpose is to position the transducer 20 in its zero or forwardly pointing position. As will be seen in FIGS. 3 and 4 the printed circuit board 80 is located laterally of the motors 10 and 12 and constitutes the motor controller for the azimuth motor 10 and the elevation motor 12. The board mounts various components, one of which is illustrated as a transistor 82.

Figure 7:
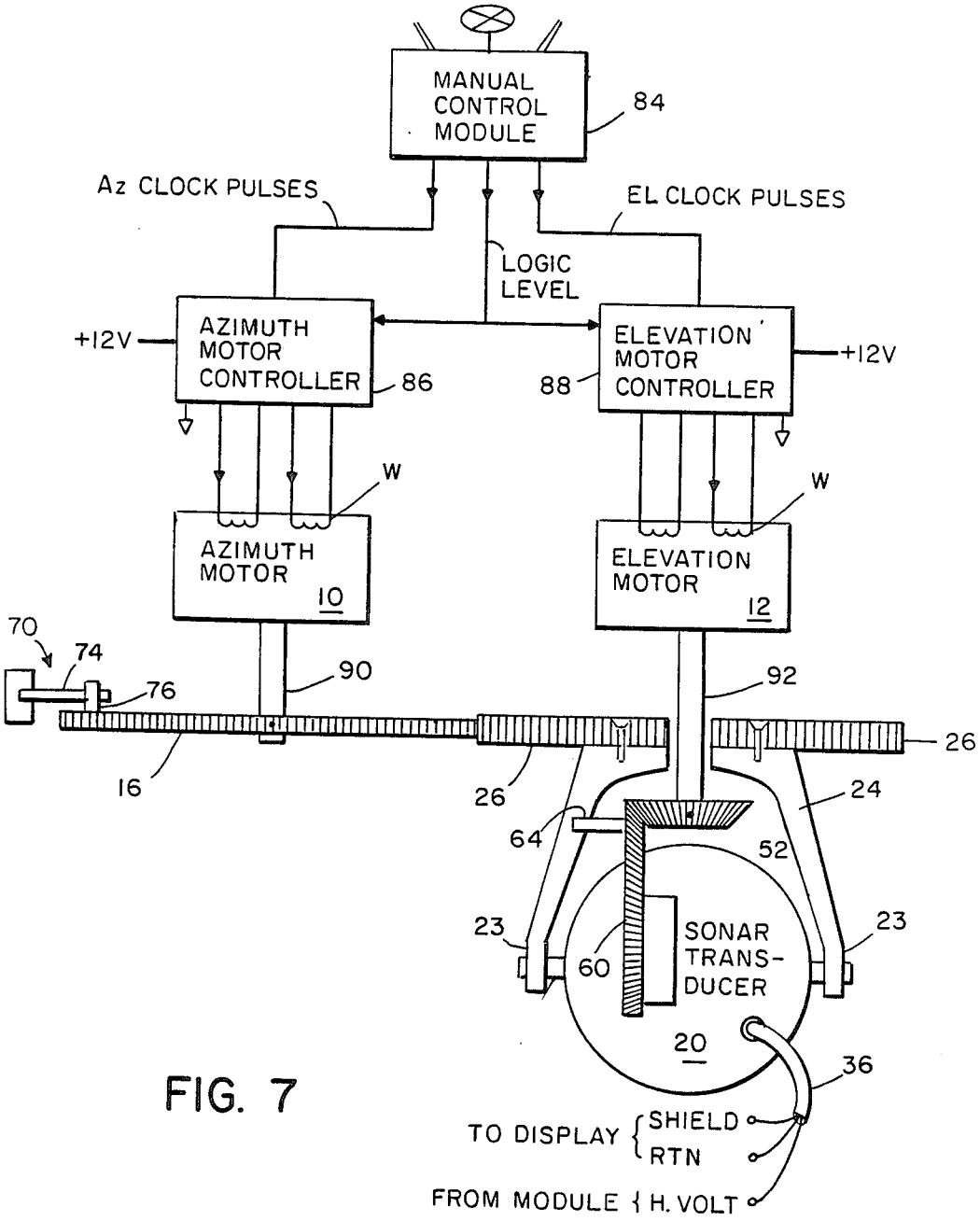
FIG. 7 is a schematic view of the control and operating mechanism.

Referring next to FIG. 7, there will be seen a schematic electronic diagram to describe the manner in which the apparatus operates. A conventional commercial manual control module 84 is located in the cockpit of the boat and may include a transceiver to transmit and receive ultrasonic pulses, a signal processer, a display and display driving circuits, controls including circuitry to generate azimuth and tilt signals. Azimuth and elevation clock pulse signals from the module 84 are coupled to an azimuth motor controller 86 and elevation motor controller 88, respectively which are embodied in the PC board 80 in the sonar 5.

If the plus 5 Volt signal is coupled to the azimuth and elevation controllers along with azimuth and elevation clock pulses the controllers supply voltage to the windings W of both motors (10 and 12) of proper polarity to rotate shaft 90 clockwise and 92 counterclockwise (cw). Conversely with 0 volts logic level applied to each controller 86 and 99 along with elevation and azimuth clock pulses the shafts are rotated counterclockwise. If change in tilt angle only is desired, no azimuth clock pulses are sent from the module 84 while logic level direction and elevation clock pulses are sent to the elevation motor controller 88.

The azimuth stepping motor 10 and the elevation stepping motor 12, hereinabove described, are respectively controlled by signals from the motor controllers 86 and 88. In addition, the manual control module supplies a battery voltage of +12 Volts D.C. to power the controllers and motors and a ground wire for both. Lastly, under manual control by the operator either a +5 v or 0 volt logic level is sent to the controllers to control the rotational direction of the motors.

The stepping motors 10 and 12 operate in conventional fashion with 12 volt two phase input to the windings W from respective controllers 86 and 88.

Initially, the operator, using the manual control module 84 sends an Az clock signal and +5 v logic level signal to the Az & EL motor controllers to place the sonar transducer 20 in the zero or start position. The azimuth stepping motor 10 is rotated until the pin 76 on the driving gear 16 is in engagement with the stop arm 74. In this position, the transducer 20 is pointing straight forward in the direction of movement of the boat.

Next, only the elevation motor 10 is energized, until the upper stop 64 on the gear quadrant 60 is in engagement with the yoke 24. This places the sonar transducer 20 in a vertical position aimed parallel to the surface of the water.

Next, the transducer 20 is adjusted to the desired tilt angle. To do this, no input is given to the azimuth motor controller 86 and the azimuth motor 10 maintains the sonar pointing directly forward. The elevation motor 12 is engaged to rotate downwardly to the desired angle at 1.8° per motor step from each EL clock pulse coming from the module 84.

The apparatus is now ready for azimuth scanning. In accordance with the invention there will be no change in the elevation angle of the sonar transducer 20 during scanning. If the azimuth motor 10 were caused to rotate shaft 90 without attendant rotation of shaft 92, unwanted changes would begin to take place in the tilt angle because the elevation motor 12 locks the pinion gear 52 stationary and the pivotal motion of the transducer would cause the gear quadrant 60 to rotate around the pinion 52 causing the transducer 20 to tilt. Accordingly, to achieve azimuth rotation in azimuth only, both the azimuth motor 10 and the elevation motor 12 must be operated simultaneously to fully compensate for the rotational movement of the transducer 20 and its yoke 24. Both motors are stepped from the elevation and azimuth controllers 86 and 88. If the azimuth motor 10 is stepped to rotate in the clockwise direction, the driving gear turns clockwise and the gear 26 and the yoke turn counterclockwise. Since the bevel gear 52 must turn counterclockwise to compensate for the movement of the quardrant 60, the elevation motor is stepped counterclockwise or opposite to the azimuth motor but at the same number of steps. The elevation motor 12 is stepped in a counterclockwise direction at the same number of steps, resulting in no change in tilt age.

We claim:

1. A dual axis transducer assembly comprising:

(a) a transducer;

(b) a yoke mounting the transducer for tilting movement about a substantially horizontal axis;

(c) a turntable mounting the yoke and the transducer for azimuthal movement about a substantially vertical axis;

(d) an elevation motor for imparting tilting movement to the transducer;

(e) an azimuth motor spaced from the elevation motor, the turntable and the yoke for imparting rotational azimuthal movement to the transducer;

(f) means for rigidly mounting both motors so that each can impart motion to the transducer without moving relative to each other; and (g) means for operating the motors in opposite directions at the same angular speed to prevent the transducer from being tilted while being pivoted in the azimuthal direction.

2. A dual axis transducer assembly comprising:

(a) a transducer;

(b) a yoke mounting the transducer for tilting movement about a substantially horizontal axis;

(c) a turntable mounting the transducer and yoke for oscillating azimuthal movement about a substantially vertical axis;

(d) a fixed surface extending substantially normal to said vertical axis and parallel to the turntable, the surface being spaced from the turntable to create a gap between them;

(e) a writing harness extending from the transducer and arranged in a coil within the gap, which coil expands and contracts as the transducer is oscillated about the vertical axis to impart minimal stress to the transducer and reduce wire fatigue;

(f) an elevational motion imparting motor and an azimuthal motion imparting motor; and (g) means for operating the motors in opposite directions at the same angular speeds to prevent the transducer from being tilted while being pivoted in the azimuthal direction.

3. A dual axis transducer assembly comprising:

(a) a transducer;

(b) a yoke mounting the transducer for tilting movement about a substantially horizontal axis;

(c) a turntable mounting the yoke and the transducer for azimuthal movement about a substantially vertical axis;

(d) an elevation motor for imparting tilting movement to the transducer;

(e) an azimuth motor for imparting rotational azimuthal movement to the transducer; and (f) means for operating the motors in opposite directions at the same angular speed for preventing tilting motion from being imparted to the transducer when azimuthal motion is being imparted.

4. A dual axis transducer assembly comprising:

(a) a transducer;

(b) a yoke mounting the transducer for tilting movement about a substantially horizontal axis;

(c) a turntable mounting yoke and the transducer for azimuthal movement about a substantially vertical axis;

(d) an elevation motor for imparting tilting movement to the transducer;

(e) an azimuth motor spaced from the elevation motor, the turntable and the yoke for imparting rotational azimuthal movement to the transducer;

(f) a driving gear secured to the azimuth motor in engagement with a driven gear secured to the yoke to transmit rotary motion to the yoke;

(g) a bevel gear in engagement with a gear quardrant secured to the transducer;

(h) a shaft passing through the yoke and the driven gear and mounted for free rotational movement relative to the yoke and driven gear, the shaft being secured to the elevation motor to impart tilting motion to the transducer independent of the rotational azimuthal motion and;

(i) means for operating the motors in opposite directions at the same angular speed for preventing tilting motion from being imparted to the transducer when azimuthal motion is being imparted.

5. A dual axis transducer assembly comprising:

(a) a transducer;

(b) a yoke mounting the transducer for tilting movement about a substantially horizontal axis;

(c) a turntable mounting the yoke and the transducer for azimuthal movement about a substantially vertical axis;

(d) an elevation stepping motor for imparting tilting movement to the transducer;

(e) an azimuth stepping motor spaced from the elevation motor, the turntable and the yoke for imparting rotational azimuthal movement to the transducer;

(f) a driving gear secured to the azimuth motor in engagement with a driven gear secured to the yoke to transmit rotary motion to the yoke;

(g) a bevel gear in engagement with a gear quardrant secured to the transducer;

(h) a shaft passing through the yoke and the driven gear and mounted for free rotational movement relative to the yoke and driven gear, the shaft being secured to the elevation motor to impart tilting motion to the transducer independent of the rotational azimuthal motion; and (i) means for stepping the azimuth motor in one direction and for stepping the elevation motor in the opposite direction at the same angular speed to prevent the transducer from being tilted while being pivoted in the azimuthal direction.

* * * * *